United States Patent [19]

Liu et al.

[11] Patent Number: 4,604,168

[45] Date of Patent: Aug. 5, 1986

[54] PRETREATMENT FOR ELECTROPLATING MINERAL-FILLED NYLON

[75] Inventors: Sonya W. Liu, Warren; James H. Lindsay, Fenton, both of Mich.

[73] Assignee: General Motors Corporation, Detroit, Mich.

[21] Appl. No.: 684,268

[22] Filed: Dec. 20, 1984

[51] Int. Cl.[4] ..... C25D 5/54

[52] U.S. Cl. ..... 204/30; 156/643; 204/38.4; 204/192 EC; 204/192 E

[58] Field of Search ..... 204/30, 38.4, 192 E, 204/192 EC; 156/643; 427/309, 404

[56] References Cited

U.S. PATENT DOCUMENTS

| | | | |
|---|---|---|---|
| 4,395,313 | 7/1983 | Lindsay et al. | 204/30 |
| 4,402,998 | 9/1983 | Kumagai et al. | 427/97 |
| 4,466,874 | 8/1984 | Belke, Jr. et al. | 204/192 EC |

OTHER PUBLICATIONS

C. I. Courduvelis, "Application of Plasmas in the Electroplating of Plastics".

Levy & Ma, "Interfacial Bonding of Nickel to Polyamide-Imide".

Hall et al., "Effect of Activated Gas Plasma Treatment Time on Adhesive Bondability of Polymers".

*Primary Examiner*—John F. Niebling

*Assistant Examiner*—William T. Leader

*Attorney, Agent, or Firm*—Lawrence B. Plant

[57] ABSTRACT

A method of preparing the surface of molded mineral-filled nylon to receive an adherent electrodeposited metal coating comprising the steps of: exposing the surface to a plasma glow discharge; vacuum depositing a film of chromium or titanium onto the plasma-treated surface; vacuum depositing a nickel film onto the chromium or titanium film to prevent oxidation thereof; and then vacuum depositing a copper film onto the nickel film. The plasma gas is preferably inert (e.g., argon, helium, etc.) and metal deposition is effected so as to avoid oxidation of the chromium/titanium and nickel films during processing.

4 Claims, No Drawings

PRETREATMENT FOR ELECTROPLATING MINERAL-FILLED NYLON

FIELD OF THE INVENTION

This invention relates to an improved method for pretreating molded mineral-filled nylon parts preparatory to electroplating.

BACKGROUND OF THE INVENTION

Plastics are used for many automobile decorative parts and are often electroplated (e.g., with chromium) to achieve a particular aesthetic effect. Decorative chromium plating customarily comprises successive electrodeposited layers of copper, nickel and chromium as is well known in the art. The electrodeposit must adhere well to the underlying plastic substrate even in corrosive and thermal cycling environments, such as are encountered in outdoor service and environment testing. In order to obtain durable and adherent metal deposits, the substrate's surface must be conditioned or pretreated to insure that the electrodeposits adequately bond thereto.

For strength and cost reasons, mineral-filled nylon is a very desirable plastic for many automobile applications. The term "mineral-filled nylon" (hereinafter MF-nylon) as used herein refers to plating grade polyamide resins which contain powdered (i.e., 0.2–20 microns) mineral fillers such as talc, calcium silicate, silica, calcium carbonate, alumina, titanium oxide, ferrite, and mixed silicates (e.g., bentonite or pumice). Such MF-nylons are commercially available from a variety of sources having mineral contents of up to about forty percent by weight and include such commercial products as Capron CPN 1030 (Allied Chemical), Nylon 540-110-HSP (Firestone), Minlon 11C-40 (DuPont) and Vydyne R-220 or RP 260 (Monsanto). Heretofore, a variety of wet processes have been proposed to condition or pretreat MF-nylon for electroplating. Such wet pretreatment processes call for immersion of the parts in a series of chemical solutions ending in the electroless deposition of a thin adherent metal blanket on the part which serves to conduct the electroplating current and anchor the electrodeposit to the part. Generally speaking, these wet processes have included etching the MF-nylon in such solutions as chromic-sulfuric acid, trichloroacetic acid, formic acid, sulfuric-hydrochloric acid, or iodine-potassium iodide solutions; catalyzing the surface to promote the electroless deposition; and finally the electroless deposition of Cu or Ni on the surface. Unfortunately, MF-nylon is hygroscopic and hence absorbs large quantities of water during such processing which must be removed (e.g., by baking or "normalizing" at elevated temperatures) in order to insure long term durability of the plated part. This, coupled with the environmental, safety, controllability and excessive processing time considerations associated with processing parts through a series of solutions, makes the wet processes quite costly. Proprietary pretreatment processes are commercially available from such companies as the MacDermid and the Shipley Companies among others.

OBJECT AND SUMMARY OF THE INVENTION

It is an object of this invention to provide a relatively quick, dry method for pretreating MF-nylon moldings in order to obtain adherent electrodeposits thereon. This and other objects and advantages of the present invention will be more readily apparent from the description thereof which follows.

The present invention comprehends a dry pretreatment process for obtaining adherent electrodeposits on molded MF-nylon parts by: exposing the parts to a gas plasma glow discharge sufficient to etch, and increase the bonded oxygen content of, the surface; vacuum metallizing the etched parts with about 10 nanometers (nm) to about 100 nm (preferably about 50 nm) of chromium or titanium as a bonding layer; vacuum metallizing the bonding layer with about 10 nm to about 100 nm (preferably about 50 nm) of nickel before any significant oxidation of the chromium or titanium can occur; and then vacuum metallizing the nickel layer with copper (preferably about 80 nm to about 100 nm) before any significant oxidation of the nickel can occur. The several steps of the process are preferably performed immediately, one after the other, in the same evacuated reactor without breaking the vacuum or admitting oxygen into the reactor between steps. When the aforesaid pretreating operation is completed, the part is removed from the treating chamber and is ready for such subsequent electroplating operations as may be desired e.g. decorative copper-nickel-chromium.

In some respects the process of the present invention is similar to the process described in U.S. Pat. No. 4,395,313 Lindsay et al (issued July 26, 1983 and assigned to the assignee of the present invention) in that both relate to dry processes for pretreating plastics and involve plasma and vacuum metallizing steps. Lindsay et al U.S. Pat. No. 4,395,313 describes a process for pretreating ABS and PPO by: exposing it to an RF oxygen plasma glow discharge for up to 10 minutes; vacuum depositing a bonding film of nickel (preferred), chromium, titanium, molybdenum, silicon, zirconium, aluminum or alloys thereof onto the plasma treated surface; and then, without breaking the vacuum, depositing a layer of readily electroplatable metal (e.g., copper) onto the first metal film layer for use as the primary conductive layer in subsequent electroplating operations. The aforesaid Lindsay et al process, however, is ineffective to achieve adherent electrodeposits on MF-nylon moldings—especially those having complex shapes.

Plasma gases useful with the present invention will preferably be inert (e.g., argon, helium, etc.) and may be excited or energized by subjecting the gas, at low pressure, to either a DC voltage between two spaced apart electrodes (i.e., DC plasma) or to a radio frequency field (i.e., RF plasma). While inert plasma gases are preferred, oxygen and air may also be used where tight process controls on the quality of the molding's surface and the plasma treatment parameters are possible. In this regard, the inert gas plasmas attack the surface much less aggressively than do the oxygen-containing plasma gases and are less sensitive to poorly molded surfaces and deviant process conditions than the more active oxygen-containing gases. Hence the inert gases are more foregiving and tolerant of process aberrations and more consistently result in the production of parts with good adhesion over a wider range of process parameter tolerances than the oxygen-containing gases. In any event whether with inert or oxygen-containing gases, the plasma treatment conditions for MF-nylon are less severe than the RF oxygen plasma treatment conditions recommended heretofore to pretreat AB and PPO and described in Lindsay et al U.S. Pat. No.

4,395,313, which latter treatment overetches and degrades MF-nylon surfaces and results in deposits having low peel strengths. Inasmuch as there are abundant side-chain oxygen atoms present in nylon, the milder (e.g., inert gas) plasma treatments are still effective to etch and increase the bonded oxygen at the surface without degrading the surface.

To illustrate the energy levels and exposures involved when treating MF-nylon we have found that an argon gas DC plasma should have an energy level greater than about E/p=2 volt/cm Pa, where E is the ratio of applied voltage to the distance between the system's anode and cathode (i.e., volt/cm) and p is the chamber pressure in Pa. The gas pressure should be sufficient to sustain a continuous glow and the electrodes spaced far enough apart to prevent melting of the part. The optimal E/p ratio will, of course, vary somewhat from one reactor to the next, but the 2 value is considered as a good starting point from which to adjust. In this same vein, we have found that a Branson-/IPC automatic low temperature asher Model 4003-248 RF plasma unit works best with argon when the wattage is equal to 100 divided by three times the chamber pressure expressed in torrs. Hence, about 33.3 watts would be optimum for a Model 4003-248 unit if the gas pressure were 1.0 torr. Plasma treatment time will vary inversely with the energy input and the degree of activity of the plasma gas. Hence, treatment time in an RF oxygen plasma (i.e., highly active) will be very short (e.g., about one to two minutes) as compared to DC or RF argon plasma (i.e., relatively mild) treatments which optimally require about six minutes and five minutes respectively in our test fixture. DC oxygen, and RF or DC air plasma treatments will fall somewhere in between these extremes In the case of the argon treatments, peel strengths rose slowly and then leveled off at the respective five and six minute treatment times. With argon, no significant increase or decrease of peel strength was observed for treatment times up to about 10 minutes. Whereas with RF oxygen treatments, maximum peel strengths peaked in the aforesaid 1–2 minute time frame and then fell off thereafter as the surface of the part degraded under the intense attack of the oxygen plasma.

A key aspect of the present invention is the fact that chromium (preferred) and titanium have a much higher affinity for chemical bonding with the oxygen on the surface of the nylon than most other metals and that this attribute is necessary to a bonding layer for achieving adherent electrodeposits on MF-nylon. By contrast, for example, attempts to use nickel (i.e., preferred by Lindsay et al) as the bonding layer to the plasma-treated MF-nylon surface resulted only in non-adherent electrodeposits. Unfortunately, chromium and titanium bonding layers are themselves readily oxidized which results in peeling off of subsequent metal layers applied thereto. Hence, in accordance with another key feature of the present invention, a film of nickel is deposited atop the chromium or titanium bonding layer to seal, or otherwise protect, the bonding layer film from oxidation during processing as well as after the vacuum copper has been deposited and thereby insure the adherence of subsequent deposits.

We believe (albeit with some uncertainty) that the reason the plasma treatment of the present invention is effective with MF-nylon, but that the recommended Lindsay et al treatment is not, can best be explained as follows. When parts are injection molded from MF-nylon, a thin, nylon-rich skin seemingly forms over the surface of the part. In the case of parts having complex shapes the skin will vary in thickness and stress levels at different locations on the part depending on a variety of factors in its molding history. By nylon-rich skin is meant a thin surface layer of nylon which has significantly less mineral filler content than the remainder of the part underlying the skin. We believe that this nylon-rich film must be substantially preserved during the plasma treatment step in order to consistently obtain adherent electrodeposits thereon. RF oxygen plasma etch treatments such as are recommended by Lindsay et al U.S. Pat. No. 4,395,313 etch the MF-nylon surface too aggressively (i.e., the nylon-rich skin can be too easily destroyed —especially in the thinner regions thereof) for effective control of the process, and are very sensitive to the quality of the surface of the molding. Another way to view the matter is that as a result of the significantly higher surface attack of Lindsay et al's recommended procedure, a thicker layer of surface nylon is modified and oxidized to volatile lower hydrocarbon and thereby leaves the nonvolatile inorganic fillers on the surface By either view, the aggressive plasmas can too easily overetch the surface and thereby increase the mineral filler content of the surface. Increasing the amount of filler on the surface in turn tends to interfere with the ability of the nylon to bond to the chromium/titanium bonding film and results in uneven, partially covered, poorly adherent parts. Accordingly, parts treated in accordance with the present invention will be subjected to a much milder plasma treatment than espoused by Lindsay et al in order to etch, and enhance the bonded oxygen yet still avoid increasing the mineral content of the surface to the point where it adversely affects adhesion.

As indicated above, bonding layer metals such as nickel do not chemically bond to MF-nylon as readily as they do to ABS and PPO. Rather only chromium and titanium are effective as a bonding layer to the MF-nylon. We believe that chromium and titanium's strong affinity for the nylon's bonded oxygen permits them to chemically bond to the surface where many other metals, such as nickel, will not. However, while chromium and titanium have a very strong affinity for the nylon's bonded oxygen, they also has a high propensity towards oxidation when exposed to ambient oxygen which itself causes reduced adhesion of metals deposited thereon. In this regard, test data indicates that non-adherent electrodeposits are obtained when an unprotected bonding layer oxidizes, which oxidation can occur during processing or even after the vacuum copper deposition has taken place. Hence, we have found it necessary to seal or otherwise prevent oxidation (i.e., before and after vacuum copper deposition) of the chromium or titanium bonding layer Accordingly, we vapor deposit the aforesaid nickel film atop the bonding layer before any oxidation of the chromium occurs. This nickel deposition is most conveniently and preferably carried out immediately following deposition of the bonding layer by using the same deposition chamber as used for depositing the bonding layer, and without breaking the vacuum therein between steps.

Even the nickel film, however, is sensitive enough to oxidation that it too should be protected therefrom during processing to insure adherent electrodeposits. Hence, we vapor deposit the topmost film of copper atop the nickel before any oxidation can occur so as to protect the nickel from oxidation as well as provide a highly conductive surface for the subsequent electroplating steps. In this latter regard, there is no limit on the amount of copper that could be deposited so long as it is sufficient to cover the nickel and carry the electroplating current substantially uniformly over the face of the part. Hence, copper films as low as 10 nm might be acceptable for some small parts while much greater thicknesses might be necessary for larger more complex parts. Generally, copper thicknesses of about 80 nm to about 100 nm are preferred. However, thicknesses much greater than 100 nm may be used, if desired, but do not provide any better adhesion and only add to the cost of, and time to complete, the pretreatment process. As with the nickel deposition, the copper deposition is preferably carried out in the same deposition chamber used for the bonding (i.e., Cr/Ti) and sealing (i.e., Ni) film depositions and without breaking the vacuum therein after the nickel deposition.

As indicated above, we believe that neither the bonding layer nor the nickel film should be exposed to any significant oxygen gas pressure, particularly atmospheric pressure, before it is covered by the subsequently applied coatings (i.e., nickel and copper respectively). On the other hand, it seemingly does not matter whether the plasma-treated surface is exposed to oxygen (e.g., the atmosphere) before the bonding layer is deposited. Nonetheless, it is most desirable and convenient to deposit the bonding layer promptly after the glow discharge treatment, without breaking the vacuum, since this would provide the least opportunity for contamination of the plasma-treated surface as well as shorten the overall process time.

DETAILED DESCRIPTION OF TESTS

Numerous tests were conducted on the several commercial plating grade MF-nylons mentioned above. The reactor used in these tests had a single vacuum chamber which allowed all the vacuum pretreatment steps to be performed without breaking the vacuum or otherwise exposing the part to oxygen during the pretreatment process. More specifically, the pretreatments were performed on test panels in a Varian Vacuum Bell Jar System Model NRC-3117 equipped with: a Varian DC Glow Discharge Power Supply Model 980-1200 (for plasma treatment); a five-crucible electron beam gun (for the several metallizations) and a film thickness monitor. The bell jar was 46 cm in diameter and 76 cm in height. The vacuum chamber fixturing included a panel holder, a cathode ring electrode and appropriate shielding. The ring electrode, made of 6.35 mm diameter stainless steel tubing, had a 24 cm diameter and a surface area of 270 $cm^2$ and was positioned 15 cm below the panel holder. The open end of the tubing was pinched closed to reduce any locally high plasma current concentration. The support fixturing was grounded and served as the other electrode. A gas inlet line to the chamber was provided above the fixturing such that the gas flowed from the top of the chamber down to the vacuum pump port at the bottom thereof. For each test run, several panels were mounted on the panel holder. Useful operating conditions for this particular reactor were: gas flow rate 50–100 cc/min; chamber pressure 40 Pa–67 Pa (0.3–0.5 torr); and treatment times from 1–10 minutes depending on the gas used and nature of the plasma (i.e., DC or RF generated). Optimal conditions for DC argon plasma treatment were about 100 cc/min argon flow rate; about 67 Pa chamber pressure; about 1000 DC volts; and about 6 minutes of exposure. During the first minute of plasma treatment, the ring electrode would heat up, changing the current-voltage characteristics of the glow discharge. Accordingly, it was necessary to monitor the power output to maintain the desired voltage constant.

According to one specific procedure used, the panel holder was placed in the vacuum chamber so that the surfaces to be treated faced down toward the electron-beam crucible (metal source). The chamber was pumped down below 0.9 mPa. For the plasma pretreatment, argon was adjusted to flow through the chamber at 100 cc/min, while maintaining a chamber pressure of 67 Pa. The power supply was turned on, starting the discharge. The plasma was maintained at 1000 V for six minutes. After the plasma treatment was completed, the argon flow was discontinued and, without breaking the vacuum, the chamber was pumped down to a pressure of 2.0 mPa for the metallization steps. At this pressure, the electron beam could be operated to melt the metal contained in the crucible. One hundred (100) nm of chromium was first deposited. The thickness of the chromium deposit was estimated by a quartz-crystal digital thickness monitor. When the monitor indicated that the desired thickness had been reached (i.e., about 100 nm), the electron beam was turned off and the chromium deposition discontinued. After switching the crucible location so that the next metal to be deposited was at the focus of the electron beam, the same procedure was repeated. In this manner, one hundred (100) nm each of nickel and copper were then consecutively deposited.

Once the copper film has been applied over the nickel film, the vacuum can be released and the metallized surface exposed to ambient atmosphere and the parts removed from the chamber. They can then be electroplated according to any desired plating system so long as it is compatible with the copper film atop the part. For Jacquet peel testing (i.e., a measure of adhesive strength), the panels were electroplated, in an additive-free acid copper solution (i.e., 45–60 g/L $H_2SO_4$, 180–240 g/L $CuSO_4.5H_2O$) to a uniform thickness of fifty (50) micrometers. Parts so tested demonstrated peel strengths ranging from a low of about 1.75 N/cm (only 3 samples) to a high of about 17.5 N/cm (one sample) with an average (i.e., over 65 samples) greater than 8 N/cm. In most instances the adhesive strength between the metal and the nylon exceeded the cohesive strength of the nylon so that peeling actually represented failure of the underlying MF-nylon rather than the metal bond thereto.

As with any substrate the quality of the electroplating will determine the actual service life (i.e., under various conditions) of parts pretreated according to the process of the present invention. The choice of plating systems is, of course, not a part of the present invention but will affect the performance of the part in service. We did however perform some additional testing of parts plated in various ways. For these tests the pretreated surface was finish plated in a Cu—Ni—Cr decorative plating system including a bright acid copper, a semi-bright nickel, a bright nickel and a bright chromium plate. Other samples were electroplated using a tri-nickel interlayer (i.e., between the copper and the chromium) comprising semi-bright nickel, bright nickel and Dur-Ni nickel instead of the aforesaid dual nickel layer. Panels decoratively plated with the dual nickel system passed thermal cycling tests to an equivalent of five years or more without failure but performed poorly in corrosion tests (i.e., less than one year equivalent in CASS and electrochemical corrosion testing). Improved corrosion was obtained with the tri-nickel system where the panels passed an equivalent five year electrochemical corrosion test with retained passable surface appearance and no corrosion associated adhesion failures.

While we have disclosed vacuum depositing the chromium/titanium, nickel and copper films by electron beam evaporation, we expect that any of the other normal and accepted vacuum deposition processes would be useful as well, for example, electrical resistance filament heating evaporation, induction heating vacuum evaporation, sputtering, ion plating, and the like. Hence, while the invention has been described solely in terms of certain specific embodiments thereof it is not intended to be limited thereto but rather only to the extent set forth hereafter in the claims which follow.

The embodiments of the invention in which an exclusive property or privilege is claimed are defined as follows:

1. A method of preparing a surface of molded mineral-filled nylon for electroplating thereon, comprising the steps of:

exposing said surface to a plasma glow discharge so as to etch, and increase the bonded oxygen content of, said surface without substantially increasing the mineral content thereof;

vacuum depositing a thin film of bonding metal onto said etched and oxygen-enriched surface, said bonding metal being selected from the group consisting of chromium and titanium;

vacuum depositing a thin film of nickel onto said bonding metal before significant oxidation of said bonding metal occurs, said nickel film serving to substantially prevent oxidation of said bonding metal before and after subsequent metallizing steps; and before significant oxidation of said nickel occurs, vacuum depositing a thin film of copper onto said nickel to substantially prevent oxidation of said nickel and enhance the electrical conductivity of the surface for subsequent electroplating operations.

2. A method of preparing a surface of molded mineral-filled nylon to receive an adherent electrodeposit comprising the steps of:

exposing said surface to an inert gas plasma glow discharge sufficient to etch said surface and increase the bonded oxygen content thereof;

vacuum depositing a thin film of chromium onto said etched and oxygen-enriched surface;

vacuum depositing a thin film of nickel onto said chromium film before significant oxidation of said chromium occurs, said nickel film serving to substantially prevent oxidation of said chromium before and after subsequent metallizing steps; and before significant oxidation of said nickel occurs, vacuum depositing a thin film of copper onto said nickel to substantially prevent oxidation of said nickel and enhance the electrical conductivity of the surface for subsequent electroplating operations.

3. A method of preparing a surface of molded mineral-filled nylon to receive an adherent electrodeposit comprising the steps of:

exposing said surface to an inert gas plasma glow discharge sufficient to etch said surface and increase the bonded oxygen content thereof;

vacuum depositing a thin film of chromium onto said etched and oxygen-enriched surface;

without breaking the vacuum from the chromium deposition step, vacuum depositing a thin film of nickel onto said chromium film to substantially prevent oxidation of said chromium before and after subsequent metallizing steps; and without breaking the vacuum from the nickel deposition step, vacuum depositing a thin film of copper onto said nickel to substantially prevent oxidation of said nickel and enhance the electrical conductivity of the surface for subsequent electroplaing operations.

4. A method of preparing a surface of molded mineral-filled nylon to receive an adherent electrodeposit by performing the following steps while continuously maintaining a vacuum over the surface:

exposing said surface to an argon gas plasma glow discharge sufficient to etch said surface and increase the bonded oxygen content thereof without substantially increasing the mineral content thereof;

vacuum depositing about 50 nm to about 100 nm of chromium onto said plasma treated surface;

vacuum depositing about 50 nm to about 100 nm of nickel onto said chromium to substantially prevent oxidation of said chromium before and after subsequent metallizing steps; and vacuum depositing at least about 80 nm of copper onto said nickel to substantially prevent oxidation of said nickel and enhance the electrical conductivity of the surface for subsequent electroplating operations.

* * * * *